US005088160A

United States Patent [19]

Warrick

[11] Patent Number: 5,088,160

[45] Date of Patent: Feb. 18, 1992

[54] LAP BELT WEBBING ADJUSTER

[75] Inventor: James C. Warrick, Tempe, Ariz.

[73] Assignee: Am-Safe, Inc., Chicago, Ill.

[21] Appl. No.: 475,300

[22] Filed: Feb. 5, 1990

[51] Int. Cl.[5] ..... A44B 11/10

[52] U.S. Cl. ..... 24/196; 24/171

[58] Field of Search ..... 24/638, 171, 194, 196

[56] References Cited

U.S. PATENT DOCUMENTS

| | | | |
|---|---|---|---|
| 1,183,425 | 5/1916 | Ballou | 24/194 |
| 2,803,864 | 8/1957 | Bishap . | |
| 2,846,745 | 8/1958 | Lathrop . | |
| 2,869,200 | 1/1959 | Phillips et al. . | |
| 2,876,516 | 3/1959 | Cummings . | |
| 2,893,088 | 7/1959 | Harper et al. . | |
| 2,901,794 | 9/1959 | Prete . | |
| 2,998,625 | 9/1961 | Huber . | |
| 3,029,487 | 4/1962 | Asai . | |
| 3,118,208 | 1/1964 | Wexler . | |
| 3,144,696 | 8/1964 | Carter et al. . | |
| 3,179,992 | 4/1965 | Murphy . | |
| 3,189,963 | 6/1965 | Warner et al. | 24/196 |
| 3,213,503 | 10/1965 | Carter et al. . | |
| 3,218,685 | 11/1965 | Atumi . | |
| 3,226,791 | 1/1966 | Carter . | |
| 3,256,576 | 6/1966 | Klove et al. . | |
| 3,289,261 | 12/1966 | Davis . | |
| 3,304,119 | 2/1967 | Boedigheimer . | |
| 3,312,502 | 4/1967 | Coe . | |
| 3,313,573 | 4/1967 | Smith et al. . | |
| 3,344,486 | 10/1967 | Eveland . | |
| 3,369,842 | 2/1968 | Adams et al. | 24/196 X |
| 3,505,711 | 4/1970 | Carter | 24/196 X |
| 3,576,056 | 4/1971 | Bargus . | |
| 3,591,900 | 7/1971 | Brown | 24/196 |
| 3,760,464 | 9/1973 | Higuchi . | |
| 4,148,224 | 4/1979 | Craig . | |
| 4,366,604 | 1/1983 | Anthony et al. . | |
| 4,373,234 | 2/1983 | Boden . | |
| 4,389,756 | 6/1983 | Kasama | 24/196 X |
| 4,608,735 | 9/1986 | Kasai | 24/196 |
| 4,679,852 | 7/1987 | Anthony et al. . | |

FOREIGN PATENT DOCUMENTS

| | | |
|---|---|---|
| 970611 | 9/1964 | United Kingdom . |

*Primary Examiner*—James R. Brittain

*Attorney, Agent, or Firm*—Jon Carl Gealow; James M. Wetzel; JoAnne M. Denison

[57] ABSTRACT

A seat belt webbing adjuster having a base frame provided with a moveable elongated load bar of unique shape having a substantially planar transverse surface and having multiple transverse rounded edges displaced therefrom and about which seat belt webbing is wrapped, the load bar being adapted to pinch the webbing against the body frame at the planar surface and to frictionally engage the webbing at the rounded edges. Inasmuch as said webbing is pinched only along the planar surface of the load bar, jamming of the webbing as it is adjusted is avoided and the webbing adjuster assembly can be made to loose tolerances, thus decreasing the manufacturing costs. Moreover, the load bar of the webbing adjuster is of unique construction being provided with two end keepers, wherein through use of the keepers the load bar can be positioned between flanges in the base frame by placing the keepers through slots in the flanges and press fitting them into opposite end of the load bar, thus simplifying assembly and eliminating the need to bend and stress the flanges of the base frame as was required with the traditional one piece load bar.

5 Claims, 4 Drawing Sheets

Fig. 4
PRIOR ART
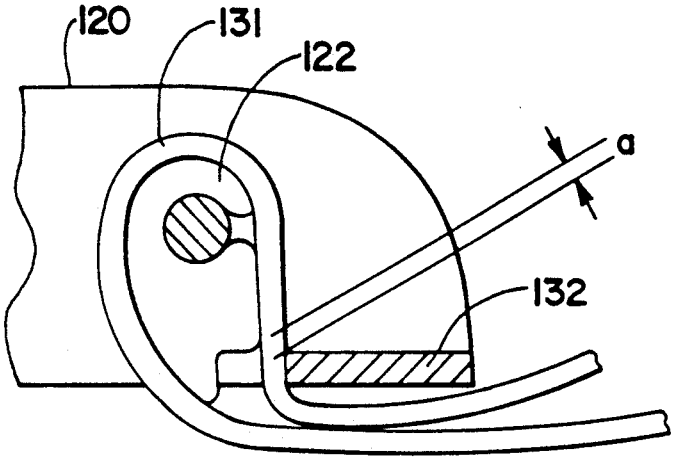
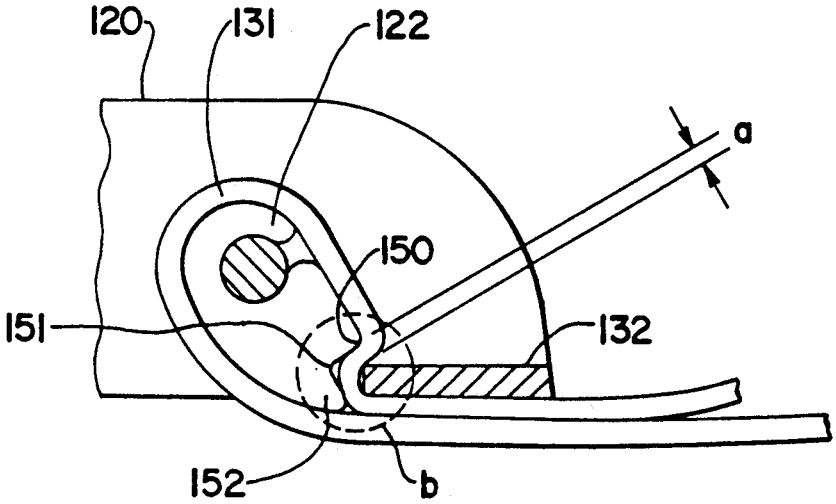
Fig. 5
PRIOR ART

Fig. 9
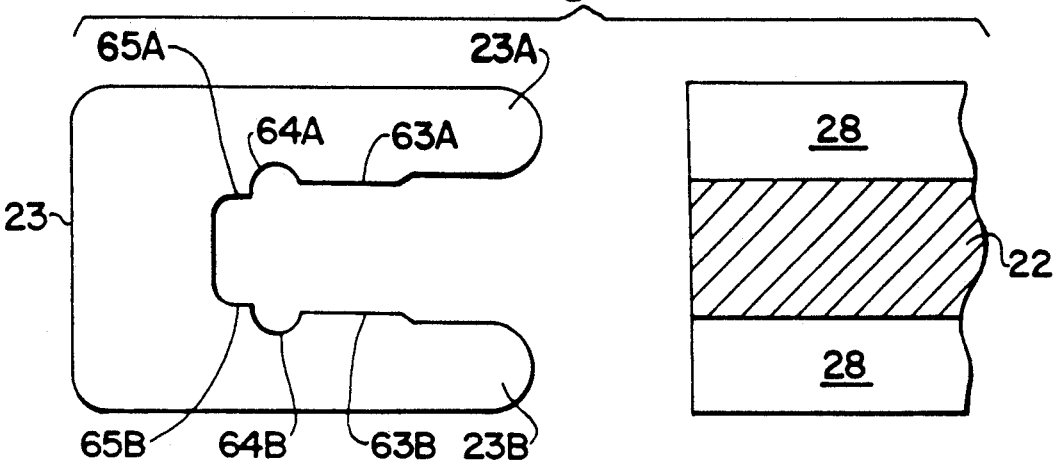
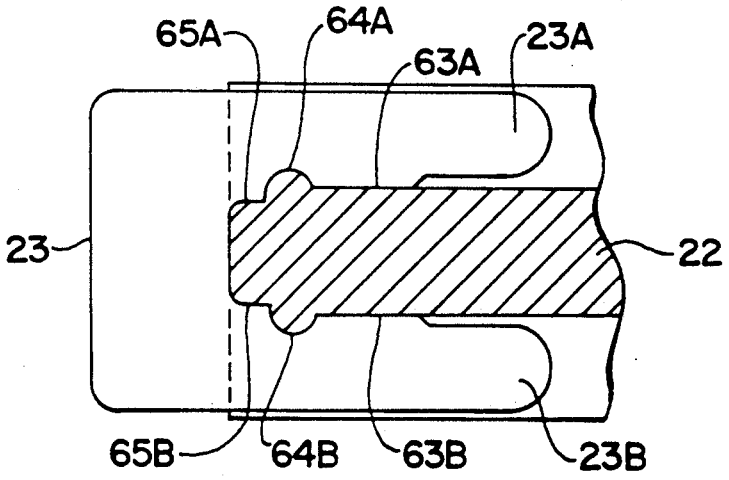
Fig. 10

LAP BELT WEBBING ADJUSTER

BACKGROUND OF THE INVENTION

1. Field of the Invention

This invention relates in general to seat belt restraint systems used in vehicles to protect the occupant in the event of sudden decelerations. In particular, it relates to seat belt webbing adjusters used in aircraft passenger lap seat belts.

2. Description of the Prior Art

As is well known, a lap seat belt, when buckled and adjusted snugly across the waist of the passenger, holds a passenger safely within a seat during sudden decelerations of a vehicle. A typical aircraft passenger lap seat belt consists of two lengths of seat belt webbing, each anchored to the seat at one end, one webbing (here selected to be the left side length) having a buckle connector attached to its free end, and the other webbing (here selected to be the right side length) having a combined buckle and webbing adjuster attached to it so that the buckle connector fits into and releasably locks with a buckle to join the two side lengths of webbing together and form the seat belt.

The webbing adjuster includes a moveable load bar in a base frame. The free end of the right side length of webbing is inserted through a slot in the bottom of the base frame, wound around the load bar, and then passed back through the slot to exit the webbing adjuster. With no tension in the webbing, the webbing adjuster is said to be in the adjustment mode and the length of belt webbing may be adjusted by pulling on the free end of the webbing.

When the belt has been joined at the connector and buckle and the webbing adjuster adjusted, only a slight amount of tension need be applied to the webbing in order to move the load bar and place the webbing adjuster into the locking mode. Thereafter, and in order to lengthen the belt, the base frame of the adjuster must be tilted in order to release the load bar and place the webbing adjuster back into the adjustment mode. The belt may then be loosened to increase the length of the anchor end of the webbing.

Typical load bars in the prior art have a knurled cylindrical shape with integral projecting lugs on each end which allows the load bar to slide between sloping slots located in the flanges of the buckle base. The knurled cylindrical shape tends to wear and fray the webbing thus decreasing the locking reliability of the web adjuster. One assembly problem associated with such an arrangement is that the flanges on the base frame first must be spread to permit the lugs to be inserted and the flanges must then be bent back into their original shape.

Another prior art combination lap belt buckle and webbing adjuster uses a partially cylindrical bar with an axle insert that partially rotates when tension is placed on the anchored portion of the right-hand webbing. However, because the gap between the load bar and the base frame is only about 75 percent of the thickness of the webbing, as shown in FIG. 4, under normal tension the load bar does not rotate far enough to securely hold the webbing between the notch and body. When heavy loads are suddenly applied to the webbing adjuster, as in deceleration during landing or crash situations, the load bar rotates further counter-clockwise, pinching and joggling the loose webbing around the end of the bar and through a close series of very tight 90° bends as shown in FIG. 5, until the webbing is clinched between the notch and the body and web lock occurs. However, moving the webbing through a series of tight bends and clinching actions in the continuous adjustments to which the belts are subjected results in excessive wear and tear on the webbing, causing it to fray and become thicker. As the webbing becomes thicker, its thickness tends to interfere with the pinching and joggling action that must take place within the close area B of FIG. 5, under load conditions. If pinching does not occur immediately as a sudden load is applied, the web lock may fail.

Other typical configurations and arrangements of seat belt adjusters seen in the prior art and in the marketplace are disclosed in U.S. Pat. No. 3,118,208, U.S. Pat. No. 3,576,056, U.S. Pat. No. 4,366,604 and U.S. Pat. No. 4,679,852.

SUMMARY

The present invention relates to seat belt webbing adjusters and specifically to those adapted for use with aircraft passenger lap seat belts. The operation of the webbing adjuster of the present invention by the passenger is the same as described above for typical prior-art webbing adjusters, but the manufacture and use of the adjuster and its load bar are improvements over the prior art. The webbing adjuster in the present invention utilizes a load bar of unique shape which provides a plurality of webbing pressure or friction generating edges which are able to grab and securely hold the webbing under severe load conditions.

Because the length of the load bar is less than the width of the base frame in which it is mounted, and by using a pair of end keepers to support the load bar, it is not necessary to spread the flanges of the buckle base frame in order to insert the load bar. Instead, after placing the bar within the base frame, a keeper is inserted through a slot in each of the two flanges and driven into two parallel grooves in each end of the load bar. The two keepers then serve the same function as the lugs on the ends of the prior-art load bars. Once a keeper has been driven into an end of the load bar, it cannot be removed. This is a result of special self-clinching attributes of the keeper.

The present invention is also an improvement over the prior art in that it spreads any load placed on the webbing over a relatively larger area. This reduces wear and tear on the webbing.

When any tensive load is applied to the webbing, which has been adjusted in the webbing adjuster, the load bar is displaced toward the bar stop in the base frame, thus pinching the webbing against further movement at that point. However, the pinching action alone does not prevent movement of the webbing because the webbing is also joggled by the continued application of tensive forces and gripped at the multiple rounded edges on the outer surface of the load bar. The bend radii at rounded edges vary from edge-to-edge in a manner so as to progressively add more friction and tension to the webbing in its path around the load bar when subject to increased loads, and also to provide for easy release on the amount of tension on the webbing when the load is removed during belt adjustment.

By relying on both the pinching action and the gripping friction at the rounded edges of the load bar, the gap between the load bar and the bar stop can be made to looser tolerances than an adjuster which relies on pinching action alone. As a result, manufacturing costs are reduced and reliability of the entire system is increased and the webbing adjuster does not tend to jam.

It is one primary object of the present invention to provide a seat belt webbing adjuster with a moveable load bar and a bar stop which uses a pinching action created by the presence of a notch in the bar as well as friction created by the relatively short radius edges in the surface of the bar in order to better grip the webbing during normal usage and most importantly during rapid deceleration as in landing or crash conditions.

It is also a primary object of the present invention to provide a seat belt webbing adjuster which uses a moveable load bar of unique configuration having an outer surface which has multiple edges with radii that vary from edge-to-edge so that the pinching of the webbing at the bar stop can be quickly boot-strapped into additional frictional forces to securely grip and lock the webbing during crash conditions, while at the same time providing for the easy release of the webbing when the adjuster is moved to its adjustment mode.

It is a further object of the present invention to provide a load bar for use in a belt webbing adjuster which uses two keepers located at either end of the load bar which allow it to easily be assembled into the base frame.

These and other objects and advantages of the present invention will become apparent from the examples given in the detailed descriptions and shown in the accompanying drawings.

BRIEF DESCRIPTION OF THE DRAWINGS

FIG. 4 is a side view, partially in cross-section, of a prior art webbing adjuster in the adjustment and normal load mode.

FIG. 5 is a side view, partially in cross-section, of the prior art webbing adjuster of FIG. 4 under high load conditions.

FIG. 9 is a view of the keeper and the end portion of the load bar of this invention in cross-section prior to press fit assembly.

FIG. 10 is a cross-sectional view of a portion of the load bar and keeper of this invention taken along lines 10—10 of FIG. 1.

DETAILED DESCRIPTION OF THE DRAWINGS

Figure 1:
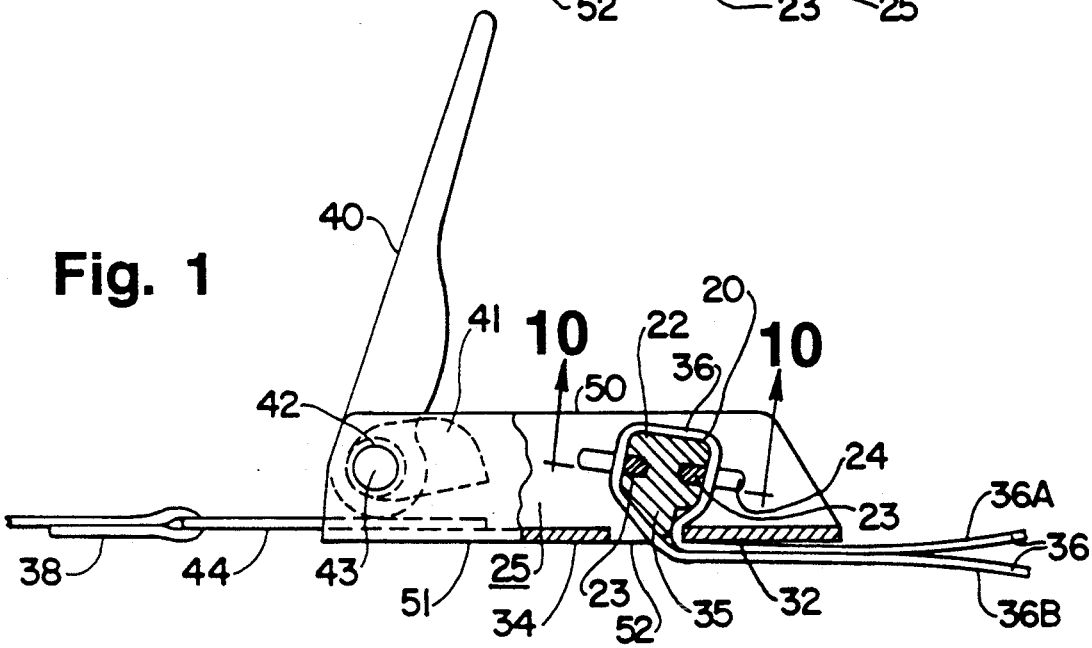
FIG. 1 is a side view of a buckle seat belt system containing the webbing adjuster of this invention partially cut away along lines 1—1 of FIG. 2.

FIG. 1 shows a lap seat belt system including a buckle 50 and a buckle connector 44 joining together the webbing 36 on the right side and webbing 38 on the left side to form the lap belt. The buckle 50 includes a base frame 51 having side flanges 25 in which the webbing adjuster 20 forming the present invention is mounted. Also shown therein is the buckle cover 40 and accompanying latch assembly including the ratchet 41 and spring 42 which are mounted about shaft 43 to releaseably engage the buckle connector 44. The webbing adjuster 20 includes the load bar 22 slideably supported in canted slots 24 of the upstanding side of flanges 25 by means of two keepers 23 located at opposite ends of the load bar 22.

Figure 2:
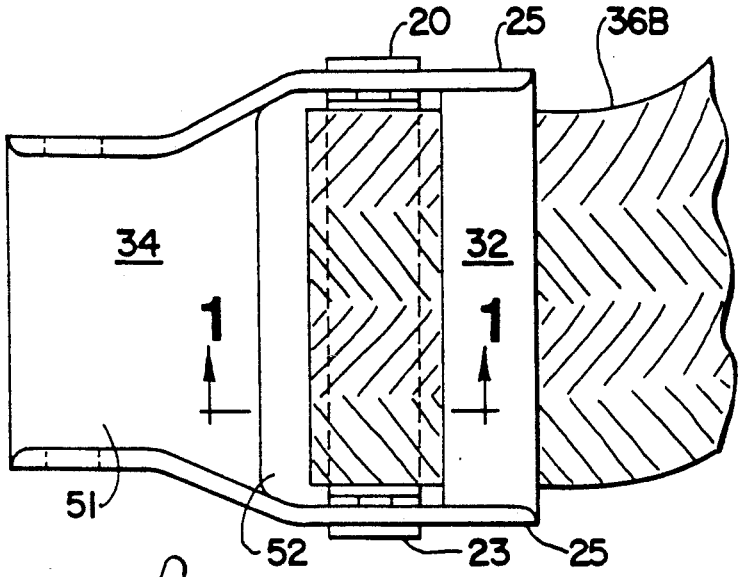
FIG. 2 is a top view of a buckle with the latch cover, latch sub-assembly and connector removed, showing the buckle base frame and the webbing adjuster of this invention.

FIG. 2 shows a top view of the buckle 50 with the buckle cover 40 and accompanying latch assembly and buckle connector 44 removed so as to present for view only the base frame 51 and webbing adjuster 20.

Figure 3:
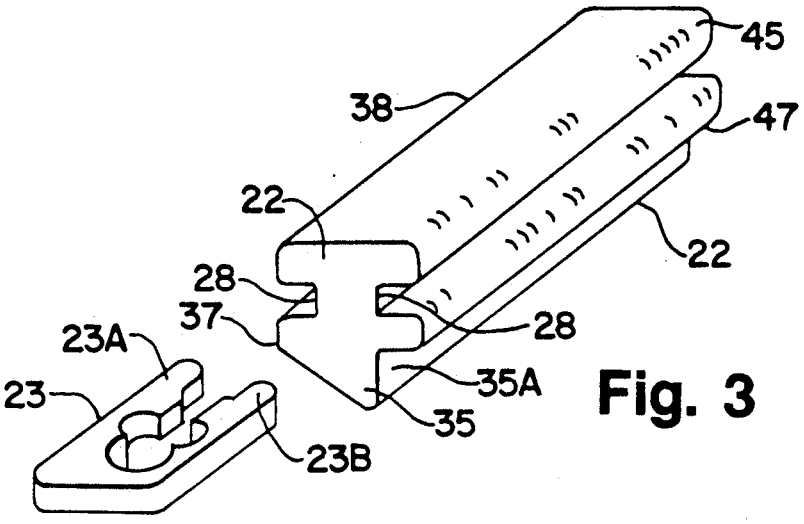
FIG. 3 is an exploded view in perspective of the load bar and keeper of the webbing adjuster of this invention.
Figure 8:
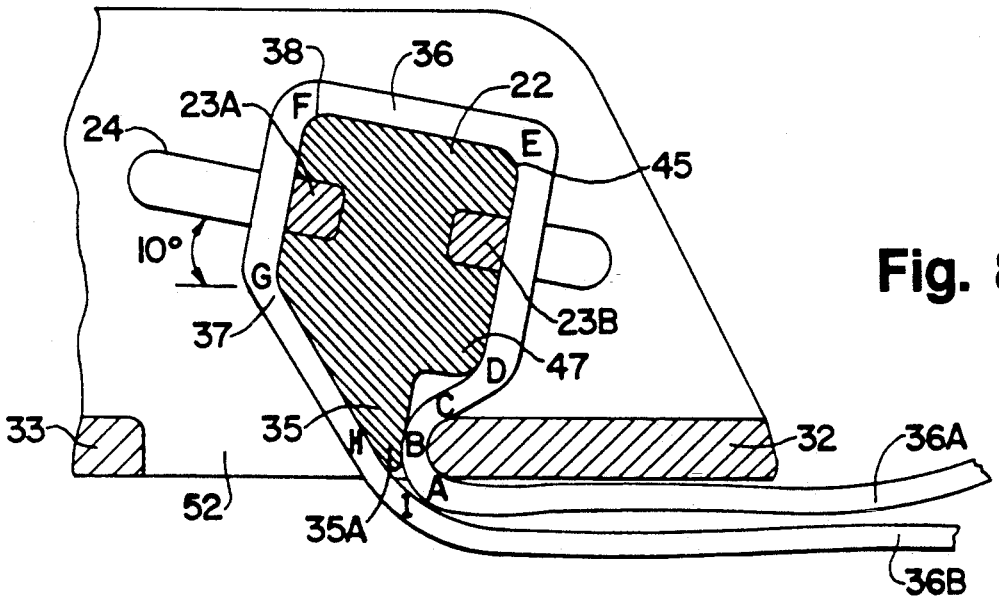
FIG. 8 is an enlarged partial side view in cross-section of the load bar, keeper and bar stop of this invention when locked under both normal and high conditions.

As shown in FIGS. 3 and 8, the load bar 22 is generally rectangular in cross-section and is shaped to include a downwardly extending tongue portion 35 having a substantially vertical planar surface 35A. The bar includes transverse rounded edges 37 and 39 and transverse rounded edges 45 and 47 of which the latter are of shorter radii of curvature than the former. Also, and as shown in FIG. 3, the load bar 22 includes a pair of transverse opposing channels 28 for receiving the tines 23A and 23B of a keeper 23 in a press fit relationship.

As may be seen in FIG. 1, installation of webbing 36 is readily accomplished by inserting the free end of the webbing 36A through slot 52 in the bottom of the base frame 51, by passing the webbing clockwise first up on the left side of load bar 22, then over its top, and then down on its right side, and finally back through base frame slot 52 to exit the base frame 51. Sufficient webbing 36 must be pulled through the webbing adjuster 20 to provide a good handhold on the free end of the webbing designated as 36A.

Specifically, as illustrated in FIG. 8, with the load bar 22 supported by the keepers 23 in the slots 24 which is canted to the base frame by approximately 10°, the webbing passes over rounded edge 37, over rounded edge 39, over rounded edge 45 and finally over rounded edge 47 to pass out of the slot between the planar surface 35A and the bar stop 32 formed by one edge of the slot 52 in the base frame 51. In passing out of slot 52 the free end of the webbing 36A comes into frictional contact with the anchor end of the webbing here designated as 36B.

Figure 6:
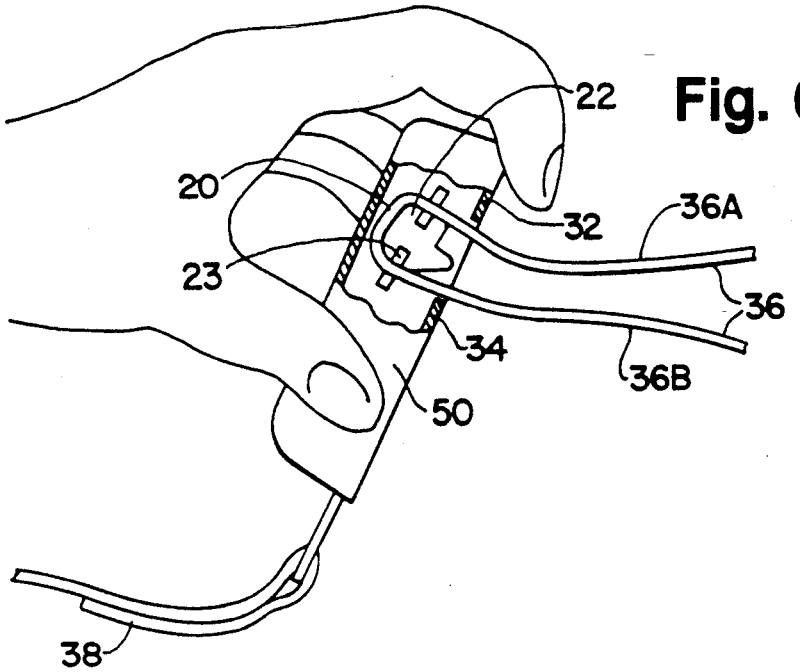
FIG. 6 is a side view, partially in cross-section, of the webbing adjuster assembly of this invention shown in the adjustment mode for lengthening the webbing.
Figure 7:
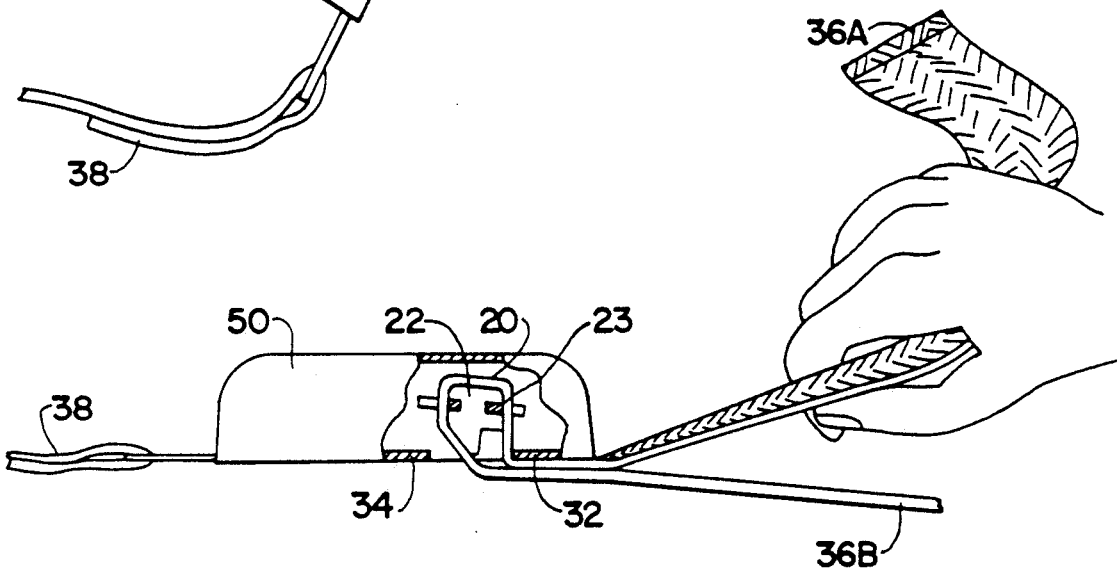
FIG. 7 is a side view, partially in cross-section, of the webbing adjuster assembly of this invention shown in the adjustment mode for shortening the webbing.

The procedure for lengthening and shortening the lap belt is illustrated in FIGS. 6 and 7. As shown in FIG. 6, when buckle 50 and the webbing adjuster 20 is rotated to an angle of approximately 50° measured between the bottom surface of base frame 51 and anchor end of webbing 36B, tension in anchor end of webbing 36B cannot cause load bar 22 to slide in the direction of bar stop 32 and thus cannot pinch the free end of the webbing 36A. The webbing 36 can then move freely over load bar 22 and the webbing adjuster 20 is said to be in its adjustment mode. Further, pulling on the buckle body 50 in the adjustment mode causes the free end 36A of webbing 36 to slide into the webbing adjuster 20 and around load bar 22 in a counter-clockwise direction, thus increasing the length of the anchored end 36B of the web.

As shown in FIG. 7, during the shortening adjustment the user pulls on the free end of the webbing 36A, causing the webbing to flow through the adjuster. Pulling on the free end of the webbing 36A causes the load bar 22 to slide to the left away from the bar stop 32. A significant feature of the invention which prevents excessive loads and wear on the webbing during the shortening adjustment is that the bend angles in the webbing at points I, H, G, and F as shown in FIG. 8 are of a large radii. These present friction areas which the webbing encounters as it moves in the clockwise direction. Accordingly, the changes in direction for the webbing at those points are slight and prevent the webbing from experiencing high tension loads at those points. As disclosed hereinafter, sharper changes in direction and higher tension loads on the webbing occur at points E, D, C, and A.

As shown in FIG. 8, there are numerous pinching and pressure edges, A through I, created in the webbing 36 around load bar 22 and between the two segments of the webbing 36A and 36B when the webbing adjuster is in the locking mode. Specifically, in the locking mode pinching pressures between the planar surface 35A and the bar stop 32 are applied to the webbing 36 along point or line B. However, that force by itself is not sufficient to lock the webbing against movement. When deceleration forces cause tension to be applied to webbing segment 36B, the webbing 36 is drawn in a counter-clockwise direction about the load bar from the pinch point B, thereby drawing the webbing into tighter contact with the bar stop 32 at point C, which in turn applies increased tension in the webbing and causes it to be drawn more firmly in contact with edge 47 at point D. Friction at point D in turn increases the tension in the segment of the webbing extending to edge 45 and causes increased friction on the webbing at point E. The described action continues at points F, G, and H in the webbing around the load bar 22. Finally, segment 36B is drawn into tight contiguous engagement with webbing segment 36A at point I, thereby completing the locking condition. The progressive increase in friction and tension forces in the webbing may be described as boot-strapping.

The initiation of the boot-strapping effect depends only on the pinching action between the surface 3$A and bar stop 32. Contrary to prior art showing in FIG. 5, the locking condition in FIG. 8 is not dependent on pinching at the gap between the rounded edge 47 of the load bar 22 and the bar stop 32. Dimension "L" in FIG. 8, is considerably larger than the thickness of the webbing 36, thus ensuring that the load bar 22 will be pulled to the locking condition by tension in webbing 36B regardless of large variations in the thickness of webbing 36. Large gap "L" also assures that the adjustment mode shown in FIGS. 6 and 7 can take place without the possibility of the webbing being jammed or wedged into gap "L".

As can be seen from FIGS. 9 and 10, the tines 23A and 23B of the keeper 23, at their tips are spread apart by a distance greater than that separating the channels 28 in the load bar 22 so that in assembly the keeper may first be aligned into the channels 28 by hand. However, the tines 23A and 23B also include guide shoulders 63A and 63B, notches 64A and 64B and gripping shoulders 6$A and 65B. The distance between the shoulders 63A and 63B is approximately the distance separating the channels 28 in the load bar 22 so as to guide the keeper in place. Thereafter, when the keeper 23 is press fit into place as shown in FIG. 10, material from the load bar 22 is displaced by the shoulders 65A and 65B into the notches 64A and 64B thereby creating a reliable mechanical interlock between keeper 23 and load bar 22.

Although not limited to these materials in the preferred embodiment, the load bar 22 is made of an aluminum alloy and the keeper 23 is made of a heat treatable steel. As can be observed from FIG. 3, all of the surfaces of load bar 22 are such that the bar can be made in a continuous method of metal extrusion, and the load bar segments for use in the webbing adjuster can be cut to length and used without any additional metal processing. Similarly, the shape of the keepers 23 are such that they can be produced in a sheet metal stamping process and heat treated. These inexpensive manufacturing processes can be employed because of the loose tolerances permitted by the inventive combination.

It is understood that the buckle and buckle connector illustrated are standard prior art items which exemplify the manner in which webbing adjusters are presently incorporated into aircraft passenger lap seat belt systems. In practice the webbing adjuster of the invention might not be incorporated in the buckle but might be incorporated in the buckle connector or might be mounted to either side length of webbing independent of the buckle and buckle connector.

Finally, the foregoing description is only exemplary of a preferred embodiment of the present invention, and it is anticipated that other variations within the scope of the invention will be recognized by those skilled in the art. It is intended that the appended claims cover not only the preferred embodiment described herein but those variations falling within the scope of the invention.

What is claimed is:

1. A webbing adjustor for adjusting and locking seat belt webbing which is anchored at one end, the webbing adjuster including a base frame, said base frame including a transverse bar stop, an elongated load bar mounted for sliding movement on said base frame toward and away from said bar stop, said load bar having an outer surface about which the webbing is wrapped in a forward direction from said anchored end, said outer surface of said load bar having a transverse substantially planar surface and a plurality of transverse rounded edge surfaces each having a radius of curvature, said rounded edge surfaces displaced from said planar surface and from each other, the position of said planar surface on said load bar relative to said bar stop being such that when the webbing is placed under tension, it is pinched over a transverse area between said planar surface and said bar stop, the webbing when placed under further tension from the anchor end is moved in the reverse direction from said pinched area and progressively frictionally gripped at each of said plurality of rounded edge surfaces, the radii of curvature of all of said rounded edge surfaces closer to the anchored end being larger than all of the rounded edge surfaces of said plurality of rounded edge surfaces closer to the pinched area of the webbing, such that the frictional gripping of the webbing is greatest near the pinched area and less near the anchored end of the webbing.

2. The webbing adjuster of claim 1, wherein said webbing under tension is bent in a first direction around said bar stop, and in the opposite direction around said load bar.

3. A webbing adjuster for seat belt webbing, which includes a base frame, an elongated load bar mounted in the base, frame by a pair of keepers for sliding movement on the base frame, each of said keepers having two spaced apart tines the inner surfaces of which are adapted to be received in transverse slots of said load bar, first to center it, and then to securely position said load bar on said bar frame, said base frame having a transverse substantially planar surface and a transverse rounded edge surface displaced therefrom, said surfaces being positioned on said load bar so as to pinch webbing wrapped around said load bar between said planar surface and said base frame and to frictionally grip the webbing at said rounded edge surface.

4. The webbing adjuster set forth in claim 3 wherein said keepers are constructed so that a first distance between first opposing faces of said tines at their ends is greater than a second distance between second opposing faces of the tines inward from their ends such that said tines operate to center said load bar on said base frame and then to press fit said keepers to said load bar for securely retaining said load bar in position on said base frame.

5. The webbing adjuster set forth in claim 4 wherein said keepers are constructed to include a pair of oppositely disposed notches positioned between said first opposing faces and said second opposing faces of said tines so that as said keepers are press fit to said bar, said second opposing faces of said tines displace material from said load bar into said notches, thereby creating a mechanical interlock between said keeper and said load bar.

* * * * *

UNITED STATES PATENT AND TRADEMARK OFFICE

CERTIFICATE OF CORRECTION

PATENT NO. : 5,088,160

DATED : February 18, 1992

INVENTOR(S) : Warrick, James C.

It is certified that error appears in the above-identified patent and that said Letters Patent is hereby corrected as shown below:

Column 5, line 5 after the numeral 32 and before the period insert - thus shifting to adjustment mode in which the webbing can move freely around the load bar -

Column 5, line 44 change 3$A to 35A

Column 5, line 65 change 6$A to 65A

Signed and Sealed this

Twentieth Day of April, 1993

*Attest:*

MICHAEL K. KIRK

*Attesting Officer*

*Acting Commissioner of Patents and Trademarks*